US010953424B2

(12) United States Patent
Coffman et al.

(10) Patent No.: US 10,953,424 B2
(45) Date of Patent: Mar. 23, 2021

(54) FLEXIBLE THREE-DIMENSIONAL MASKANTS

(71) Applicant: The Boeing Company, Chicago, IL (US)

(72) Inventors: Matthew A. Coffman, Saint Charles, MO (US); Jonathan Allan Frecks, Wentzville, MO (US); Carrie E. Kniker, Shrewsbury, MO (US)

(73) Assignee: The Boeing Company, Chicago, IL (US)

( * ) Notice: Subject to any disclaimer, the term of this patent is extended or adjusted under 35 U.S.C. 154(b) by 132 days.

(21) Appl. No.: 16/238,869

(22) Filed: Jan. 3, 2019

(65) Prior Publication Data

US 2020/0215563 A1 Jul. 9, 2020

(51) Int. Cl.
*B05B 12/24* (2018.01)
*B05D 1/02* (2006.01)
*B05C 21/00* (2006.01)

(52) U.S. Cl.
CPC ..... *B05B 12/24* (2018.02); *B05C 21/005* (2013.01); *B05D 1/02* (2013.01)

(58) Field of Classification Search
CPC ..... B05B 12/24
See application file for complete search history.

(56) References Cited

U.S. PATENT DOCUMENTS 5,786,028 A * 7/1998 Cantwell ..... B05B 12/24 427/282
6,629,696 B1 * 10/2003 Voss ..... B05B 12/26 277/630
2006/0068108 A1 * 3/2006 Beckord ..... B05B 12/20 427/256
2008/0248203 A1 * 10/2008 Eliason ..... B05B 12/265 427/259
2017/0066007 A1 * 3/2017 Brown ..... B05B 12/24

* cited by examiner

*Primary Examiner* — Charles Capozzi
(74) *Attorney, Agent, or Firm* — McDonnell Boehnen Hulbert & Berghoff LLP

(57) ABSTRACT

In an example, a flexible three-dimensional (3D) maskant is described. The maskant comprises a flexible base structure comprising a first side and a second side opposite the first side, where the first side is configured to attach and conform to a surface being spray coated. The maskant further comprises a plurality of members attached to, and protruding from, the second side of the base structure. Each member comprises (i) a base end attached to the second side of the base structure and (ii) a distal end. An outermost subset of the plurality of members are positioned along an outer edge of the base structure. Each distal end of the outermost subset extends outward beyond the outer edge of the base structure, thereby overhanging the surface when the maskant is attached to the surface of the object being spray coated.

20 Claims, 15 Drawing Sheets

FLEXIBLE THREE-DIMENSIONAL MASKANTS

FIELD

The present disclosure relates generally to maskants, and more particularly, to flexible three-dimensional (3D) maskants of various configurations that enable creation of tapered or feathered edges when spray coating a surface.

BACKGROUND

A surface can be coated with a material in various ways, such as using spray atomization. Maskants are typically temporarily attached to surfaces to protect designated areas of the surfaces when the surfaces are coated with a material.

Existing maskants often do not achieve desired effects when an area is spray coated. Masking tapes, for instance, can leave hard edges in the material. Hard edges in coated material are often undesirable, and feathered or tapered edges are preferred instead. Thus, when spray coating leaves hard edges, these edges are typically sanded, which can damage the surface and increase the amount of time spent preparing a coated surface. Multiple layers of masking tapes can be strategically applied and removed over consecutive passes of a spray applicator in order to create a taper, but this existing technique can involve more time and labor than desired. Typically, existing maskants require a large amount of time to cover designated areas, particularly when such areas are large and/or involve surfaces with complex curvatures. Further, existing maskants that are designed to help achieve feathered or tapered edges of a coated material have drawbacks as well. For instance, such maskants are not typically reusable, are costly to manufacture, and are often unable to match complex curvatures.

What is needed are maskants that are reusable, efficient to apply, versatile, and less costly, while also achieving desired effects when spray coating a surface.

SUMMARY

In an example, a flexible three-dimensional (3D) maskant is described. The flexible 3D maskant comprises a flexible base structure and a plurality of members. The flexible base structure comprises a first side and a second side opposite the first side. The first side is configured to attach and conform to a surface of an object being spray coated. The plurality of members are attached to, and protruding from, the second side of the flexible base structure. Each member comprises (i) a base end attached to the second side of the flexible base structure and (ii) a distal end. An outermost subset of the plurality of members are positioned along an outer edge of the flexible base structure. Each distal end of the outermost subset extends outward beyond the outer edge of the flexible base structure, thereby overhanging the surface when the flexible 3D maskant is attached to the surface of the object being spray coated.

In another example, a method is described. The method comprises attaching a flexible 3D maskant to a surface of an object and spray coating at least one layer of a material onto the flexible 3D maskant and the surface. The flexible 3D maskant comprises a flexible base structure and a plurality of members. The flexible base structure comprises a first side and a second side opposite the first side. The first side is configured to attach and conform to the surface. Attaching the flexible 3D maskant to the surface comprises attaching the first side of the flexible base structure to the surface. The plurality of members are attached to, and protruding from, the second side of the flexible base structure. Each member comprises (i) a base end attached to the second side of the flexible base structure and (ii) a distal end. An outermost subset of the plurality of members are positioned along an outer edge of the flexible base structure. Each distal end of the outermost subset extends outward beyond the outer edge of the flexible base structure and overhang the surface.

In another example, a spray coating system is described. The spray coating system comprises a spray coating device and a flexible 3D maskant. The spray coating device has an atomizer nozzle. The spray coating device is configured for spray coating at least one layer of a material onto a flexible 3D maskant and a surface of an object. The flexible 3D maskant comprises a flexible base structure and a plurality of members. The flexible base structure comprises a first side and a second side opposite the first side. The first side is configured to attach to the surface. The plurality of members are attached to, and protruding from, the second side of the flexible base structure. Each member comprises (i) a base end attached to the second side of the flexible base structure and (ii) a distal end. An outermost subset of the plurality of members are positioned along an outer edge of the flexible base structure. Each distal end of the outermost subset extends outward beyond the outer edge of the flexible base structure, thereby overhanging the surface when the flexible 3D maskant is attached to the surface.

The features, functions, and advantages that have been discussed can be achieved independently in various examples or may be combined in yet other examples. Further details of the examples can be seen with reference to the following description and drawings.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying drawings, wherein:

DETAILED DESCRIPTION

Figure 1:
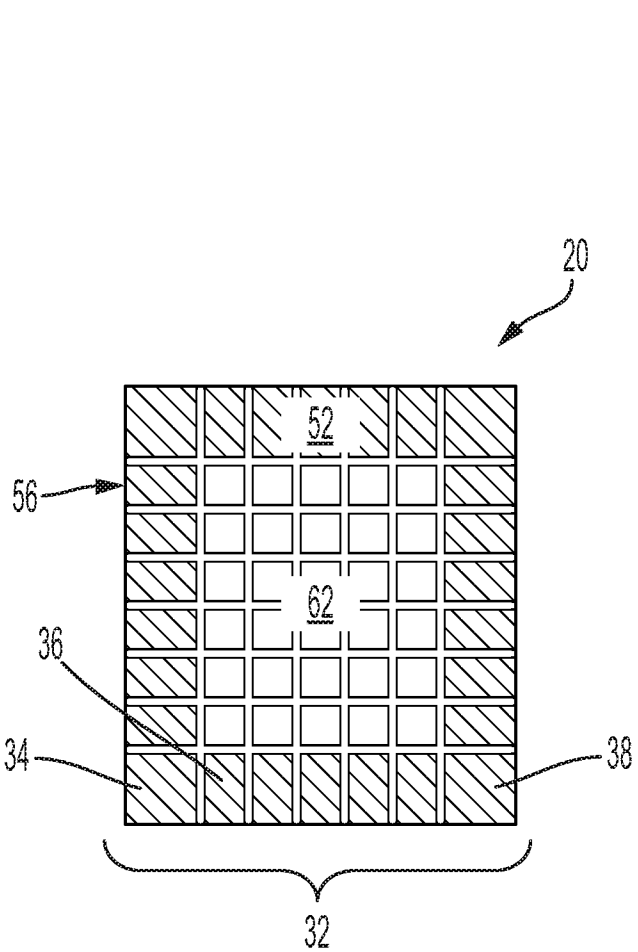
FIG. 1 shows an example of a spray coating system, including an example of a flexible 3D maskant, according to an example implementation.
Figure 1:
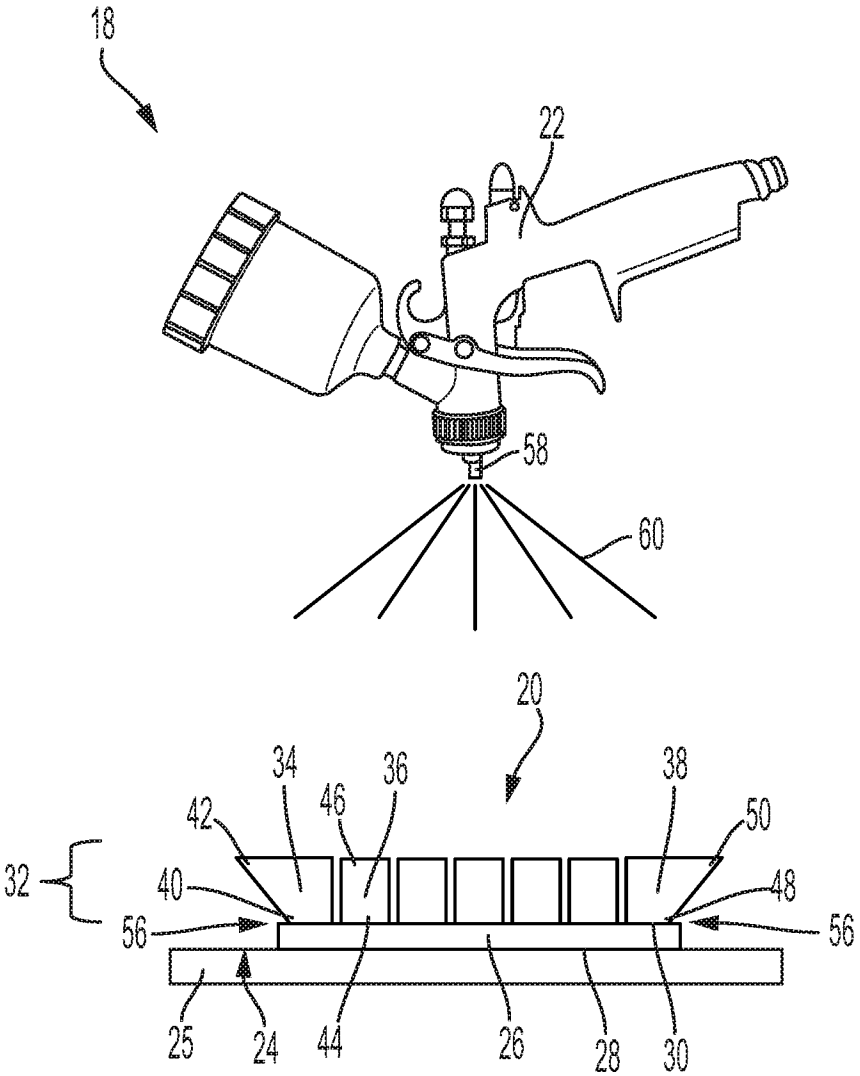

Disclosed examples will now be described more fully hereinafter with reference to the accompanying drawings, in which some, but not all of the disclosed examples are shown. Indeed, several different examples may be described and should not be construed as limited to the examples set forth herein. Rather, these examples are described so that this disclosure will be thorough and complete and will fully convey the scope of the disclosure to those skilled in the art.

By the terms "substantially," "about," and "proximate" used herein, it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

Unless otherwise specifically noted, elements depicted in the drawings are not necessarily drawn to scale.

Within examples, methods and systems relating to flexible 3D maskants are described. The disclosed flexible 3D maskants are reusable, efficient to apply, versatile, and less costly than existing maskants, while also achieving desired tapering and feathering effects when spray coating a surface. These and other improvements are described in more detail below. Implementations described below are for purposes of example. The implementations described below, as well as other implementations, may provide other improvements as well.

Referring now to the figures, FIG. 1 shows an example of a spray coating system 18. The spray coating system 18 includes an example of a flexible 3D maskant 20 and an example of a spray coating device 22. In particular, on the left side of FIG. 1 is a side view shows the flexible 3D maskant 20 attached to a surface 24 of an object 25 being spray coated, as well as the spray coating device 22 positioned above the flexible 3D maskant 20 and the surface 24. On the right side of FIG. 1 is a top-down view of the flexible 3D maskant 20.

As shown in the side view, the flexible 3D maskant 20 comprises a flexible base structure 26 comprising a first side 28 and a second side 30 opposite the first side 28, where the first side 28 is configured to attach and conform to the surface 24. Further, the flexible 3D maskant 20 also comprises a plurality of members 32 attached to, and protruding from, the second side 30 of the flexible base structure 26. For example, member 34, member 36, and member 38 are shown to be attached to, and protruding from, the second side 30 of the flexible base structure 26. Each member comprises (i) a base end attached to the second side 30 of the flexible base structure 26 and (ii) a distal end. For example, member 34 includes base end 40 and distal end 42, member 36 includes base end 44 and distal end 46, and member 38 includes base end 48 and distal end 50.

As shown in the top-down view, the plurality of members 32 includes an outermost subset 52 of the plurality of members 32 that define an outer periphery of the flexible 3D maskant 20. As shown in both views, the outermost subset 52 of the plurality of members 32 are positioned along an outer edge 56 of the flexible base structure 26 (i.e., along a perimeter of the flexible base structure 26). For example, member 34 and member 38 are each shown to be positioned along the outer edge 56. Positioned in this way, when the flexible 3D maskant 20 is attached to the surface 24, each distal end of the outermost subset 52 of the plurality of members 32 extends outward beyond the outer edge 56 of the flexible base structure 26, thereby overhanging the surface 24. As shown, for example, distal end 42 of member 34 overhangs the surface 24, and distal end 50 of member 38 overhangs the surface 24.

In addition, FIG. 1 shows that the spray coating device 22 comprises an atomizer nozzle 58. The spray coating device 22 is configured for spray coating at least one layer of a material 60 onto the flexible 3D maskant 20 and the surface 24. The material 60 can be paint or another type of material configured to be spray coated. Herein, examples are described primarily with respect to spray coating using paint.

In addition to the outermost subset 52, the plurality of members 32 can also include an inner subset 62 of the plurality of members 32 enclosed by the outermost subset 52. In the illustrated embodiment of FIG. 1, for example, the plurality of members 32 is shown to include fifty-six members, represented by a seven-by-eight grid, where the outermost subset 52 includes twenty-six members (including member 34, member 36, and member 38) and the inner subset 62 includes thirty members. However, it should be realized that the quantity of members in the plurality of members 32 can be based on the size of the flexible 3D maskant 20, the size of the individual members of the plurality of members 32, and/or based on other factors. Further, although a seven-by-eight grid of members is shown in FIG. 1, it should be understood that, in other examples, more or less members are possible and/or the plurality of members 32 might not be arranged uniformly in a grid.

The flexible base structure 26 is at least partially made of a flexible material, such as polyurethane rubber, that achieves a desired flexibility and also enables the flexible base structure 26 to be cleaned and reused. In addition, each of the plurality of members 32 can be at least partially made of polyurethane rubber or another flexible material, so as to also enable the plurality of members 32 to be cleaned and reused. Further, to facilitate temporary attachment to the surface 24, the first side 28 of the flexible base structure 26 can include or be coupled to an adhesive layer, although other techniques for attaching the first side 28 to the surface 24 are possible.

The flexible base structure 26, as well as each of the plurality of members 32, are shown as having a rectangular geometry. However, in alternative embodiments, other geometries are possible, while still achieving the improvements described herein.

Furthermore, while each distal end of the outermost subset 52 overhang the surface 24 in some embodiments, there can be alternative embodiments in which less than all of the outermost subset 52 overhang the surface 24. For example, when, instead of a tapered or feathered edge, a hard edge in the material 60 is desired proximate to a portion of the outer edge 56, the flexible 3D maskant 20 can be designed such that members of the outermost subset 52 that are positioned along the portion of the outer edge 56 do not overhang the surface 24.

The flexible 3D maskant 20 shown in FIG. 1 can be embodied in different forms. Examples of different embodiments will now be described in more detail, as well as examples of the effect such maskants have on the tapering or feathering of the material 60 on surfaces. To achieve the desired tapering or feathering effects described herein, at least one layer of the material 60 can be spray coated onto the flexible 3D maskant 20 and the surface 24 in a direction substantially normal to the surface 24.

Figure 2:
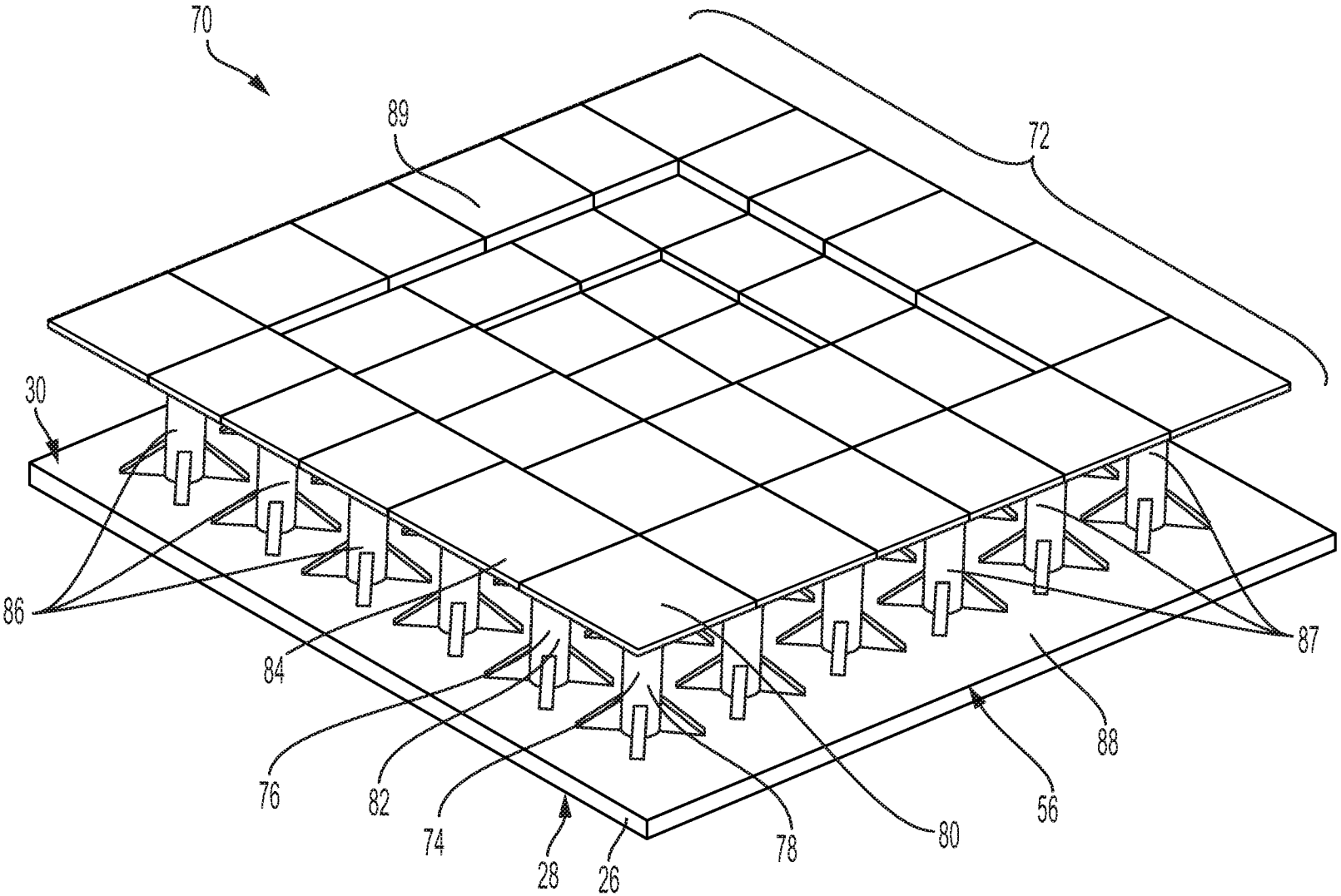
FIG. 2 shows a perspective view of another flexible 3D maskant, according to an example implementation.

FIG. 2 shows a perspective view of an example of a first flexible 3D maskant 70 in which the plurality of members 32 shown in FIG. 1 are embodied as a plurality of pins 72 that are inserted into the flexible base structure 26.

As shown, each of the plurality of pins 72 comprises a shaft connected to a head. Pin 74 and pin 76 are labeled as representative examples. Pin 74 has a shaft 78 and a head 80, and pin 76 has a shaft 82 and a head 84. In this illustrative embodiment, a distal end of a member included in the plurality of members 32 is embodied as a head of a pin included in the plurality of pins 72. For example, head 80 is the distal end of pin 74 and head 84 is the distal end of pin 76.

As further shown in FIG. 2, the outermost subset 52 of the plurality of pins 72 are positioned along the outer edge 56 of the flexible base structure 26. Pin 74 and pin 76 are both representative examples of the pins included in the outermost subset 52. In addition, pins 86 and pins 87 denote representative examples of pins that are also included in the outermost subset 52—namely, three pins 86 along one portion of the outer edge 56 and three pins 87 along another portion of the outer edge 56.

Within examples, the flexible base structure 26 has a first surface area 88, and heads of the plurality of pins 72 define a second surface area 89 that is greater than the first surface area 88. Further, shafts of the outermost subset 52 of the plurality of pins 72 are longer than shafts of the inner subset 62 of the plurality of pins 72, and heads of the outermost subset 52 at least partially overlap heads of the inner subset 62. By having the pins arranged and sized in this manner, gaps between pins can be reduced or eliminated, thereby preventing or reducing the likelihood that paint sprayed onto the first flexible 3D maskant 70 would reach the second side 30 of the flexible base structure 26 or cause overspray to reach areas of a surface (e.g., surface 24) to which the first flexible 3D maskant 70 is attached. In addition, this can reduce time spent cleaning the first flexible 3D maskant 70 before reuse. Further, the pin design of the first flexible 3D maskant 70 can make the first flexible 3D maskant 70 useful for masking highly contoured surfaces. For example, for highly contoured surfaces involving a steep convex curve, the heads of the pins can be made wide enough to protect the second side 30 from paint overspray, while still providing the overhang needed to achieve a tapered or feathered effect with the paint.

Although the first flexible 3D maskant 70 includes pins positioned on the flexible base structure 26 in rows of equal number, the first flexible 3D maskant 70 can include more or less pins in alternative examples. For example, the first flexible 3D maskant 70 can include only pins positioned along the outer edge 56. Other examples are possible as well.

A given pin of the plurality of pins 72 can be fabricated from one or more rigid or flexible substances. That is, the shaft of the pin, head of the pin, or both the shaft and head of the pin can comprise one or more of polytetrafluoroethylene, plastic, rubber, or another substance. In the first flexible 3D maskant 70, each pin is rigid, and the flexibility of the first flexible 3D maskant 70 is provided by the flexible base structure 26. Having rigid pins that are inserted into the flexible base structure 26 advantageously reduces the complexity of the first flexible 3D maskant 70. In particular, it allows for the plurality of pins 72 and the flexible base structure 26 to be fabricated separately and allow for interchangeability—that is, the ability to switch out pins to best fit the situation in which the first flexible 3D maskant 70 will be used. In addition, use of rigid pins allows the first flexible 3D maskant 70 to be more easily tailored to specific thicknesses of material 60 that is to be spray coated (e.g., change the lengths/heights of the pins while keeping the heads of the pins and the flexible base structure 26 the same). Furthermore, being able to remove and change out the plurality of pins 72 can make it easier to clean both the plurality of pins 72 and the flexible base structure 26. Other advantages are possible as well.

Figure 3:
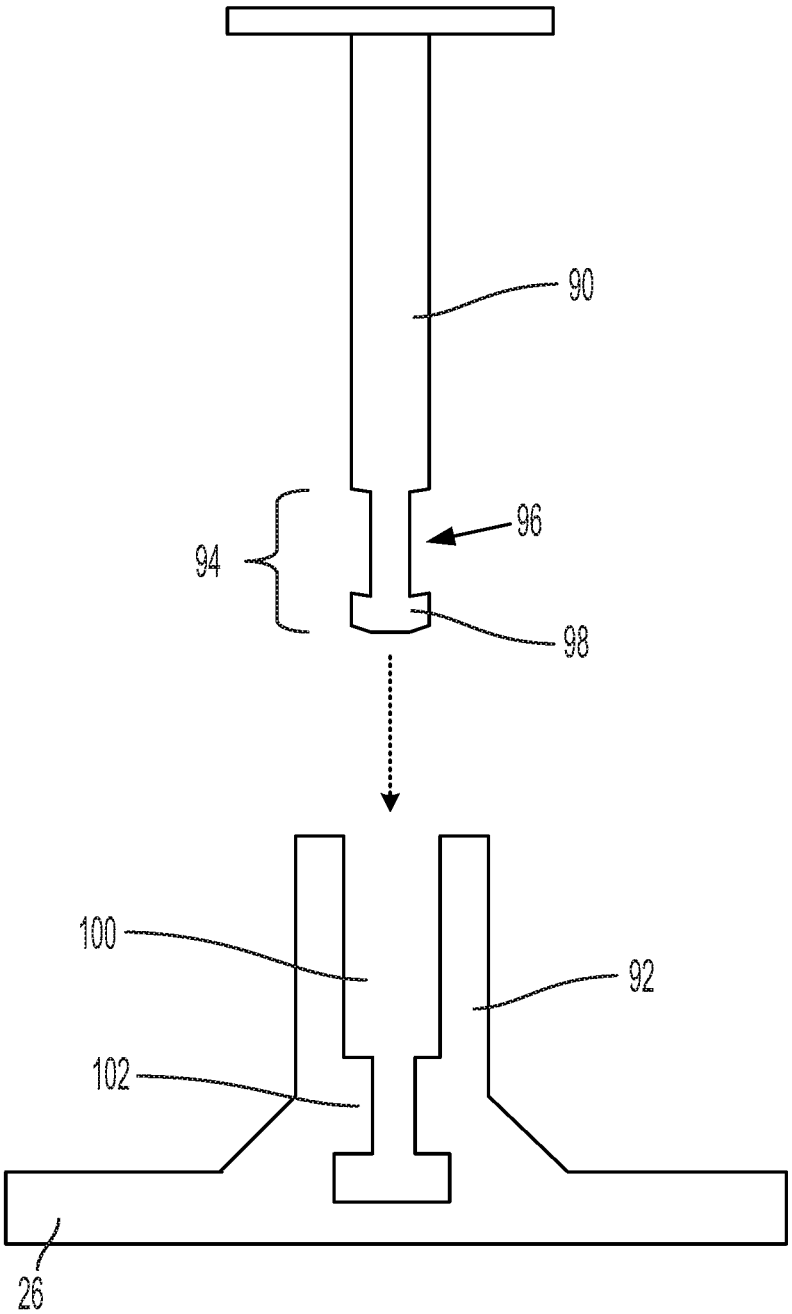
FIG. 3 shows a representative pin and a representative flexible locking structure of the flexible 3D maskant of FIG. 2, according to an example implementation.

FIG. 3 shows an example method in which a pin 90 can be removably inserted into a flexible locking structure 92 of the flexible base structure 26. One or more of the plurality of pins 72 shown in FIG. 2 can be embodied similarly to pin 90 and can be attached to the flexible base structure 26 in the manner shown in FIG. 3.

As shown, a base end 94 of the pin 90 includes a recessed portion 96 and a foot 98. The flexible locking structure 92 includes a hole 100 and a ridge 102. The pin 90 can be fabricated from polytetrafluoroethylene and the flexible locking structure 92, like the flexible base structure 26, can be fabricated from rubber. The flexible locking structure 92 is integrally formed with the flexible base structure 26 such that the flexible locking structure 92 and the flexible base structure 26 are a single piece.

The pin 90 and the flexible locking structure 92 are configured to support a snap-fit connection such that, when the pin 90 is inserted into the hole 100 of the flexible locking structure 92, the ridge 102 deflects, enabling the foot 98 to pass through to the bottom of the hole 100, and the ridge 102 engages with the recessed portion 96 once the foot 98 has passed through, thereby locking the pin 90 into place. In alternative examples, the pin 90 and the flexible locking structure 92 can be configured to connect using assembly methods other than a snap-fit connection.

In alternative examples, rather than all of the plurality of pins 72 being inserted into the flexible base structure 26, one or more pins of the plurality of pins 72 can be integrally formed with the flexible base structure 26 such that the flexible base structure 26 and the one or more pins are a single piece.

Figure 4:
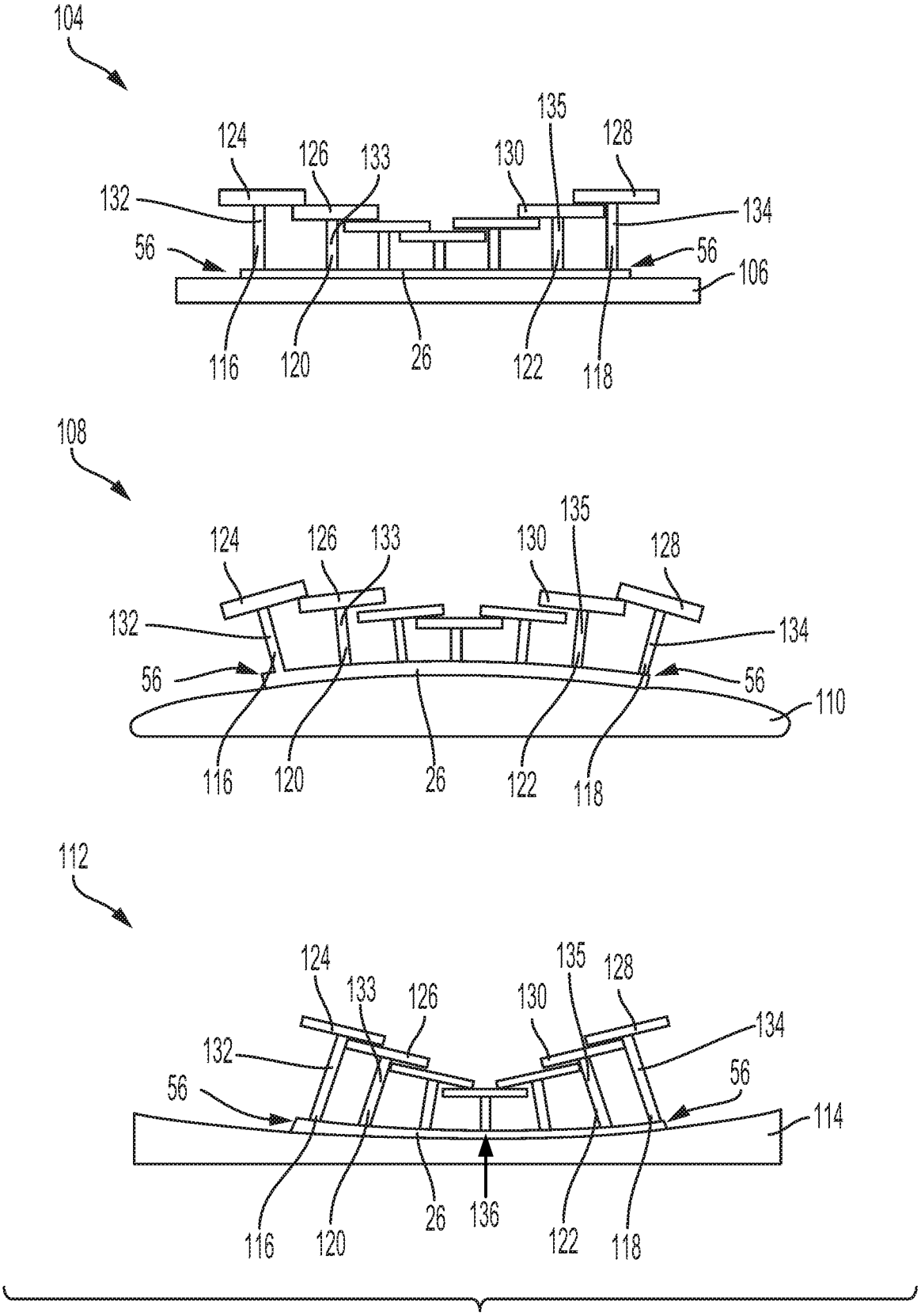
FIG. 4 shows three different cross-sectional views of the flexible 3D maskant of FIG. 2, according to an example implementation.

FIG. 4 shows three different cross-sectional views of the first flexible 3D maskant 70, as well as three different embodiments of the surface 24 of FIG. 1.

In particular, FIG. 4 shows a respective cross-sectional view corresponding to each of three positions of the first flexible 3D maskant 70: a first position 104 where the flexible base structure 26 is attached to a substantially flat surface 106, a second position 108 where the flexible base structure 26 is attached to a convex surface 110, and a third position 112 where the flexible base structure 26 is attached to a concave surface 114. As shown by each of these positions, the first flexible 3D maskant 70 can conform to a variety of differently-contoured surfaces, protect desired areas of the surfaces from paint overspray, and help create tapered or feathered edges.

Pin 116 and pin 118 are examples of pins included in the outermost subset 52 of the plurality of pins 72, and pin 120 and pin 122 are examples of pins included in the inner subset 62 of the plurality of pins 72. As shown, pin 116 and pin 118 have (i) longer shafts than pin 120 and pin 122, and (ii) heads that at least partially overlap heads of pin 120 and pin 122. For example, head 124 of pin 116 partially overlaps head 126 of pin 120, and head 128 of pin 118 partially overlaps head 130 of pin 122. In addition, shaft 132 of pin 116 is longer than shaft 133 of pin 122, and shaft 134 of pin 118 is longer than shaft 135 of pin 122.

In the first position 104, heads of the outermost subset 52 extend outward beyond the outer edge 56 of the flexible base structure 26. For example, head 124 of pin 116 and head 128 of pin 118 extend beyond the outer edge 56.

In the second position 108, the heads of the outermost subset 52 and shafts of the outermost subset 52 angle outward beyond the outer edge 56 of the flexible base structure 26. For example, shaft 132 of pin 116 and shaft 134 of pin 118 angle outward beyond the outer edge 56. In addition, head 124 of pin 116 and head 128 of pin 118 angle outward beyond the outer edge 56.

In the third position 112, the shafts of the outermost subset 52 angle inward towards a center 136 of the flexible base structure 26 and the heads of the outermost subset 52 extend outward beyond the outer edge 56 of the flexible base structure 26. As shown, for example, although shaft 132 and shaft 134 angle inward towards the center 136 of the flexible base structure 26, head 124 and head 128 extend outward beyond the outer edge 56.

Thus, in each of the three positions, a portion of the outermost subset 52 overhang the respective surface to which the first flexible 3D maskant 70 is attached, thereby causing a tapered or feathered effect proximate to the outer edge 56 of the flexible base structure 26 when the first flexible 3D maskant 70 and the surface are spray coated with paint. A representative illustration of this effect is shown next in FIG. 5.

Figure 5:
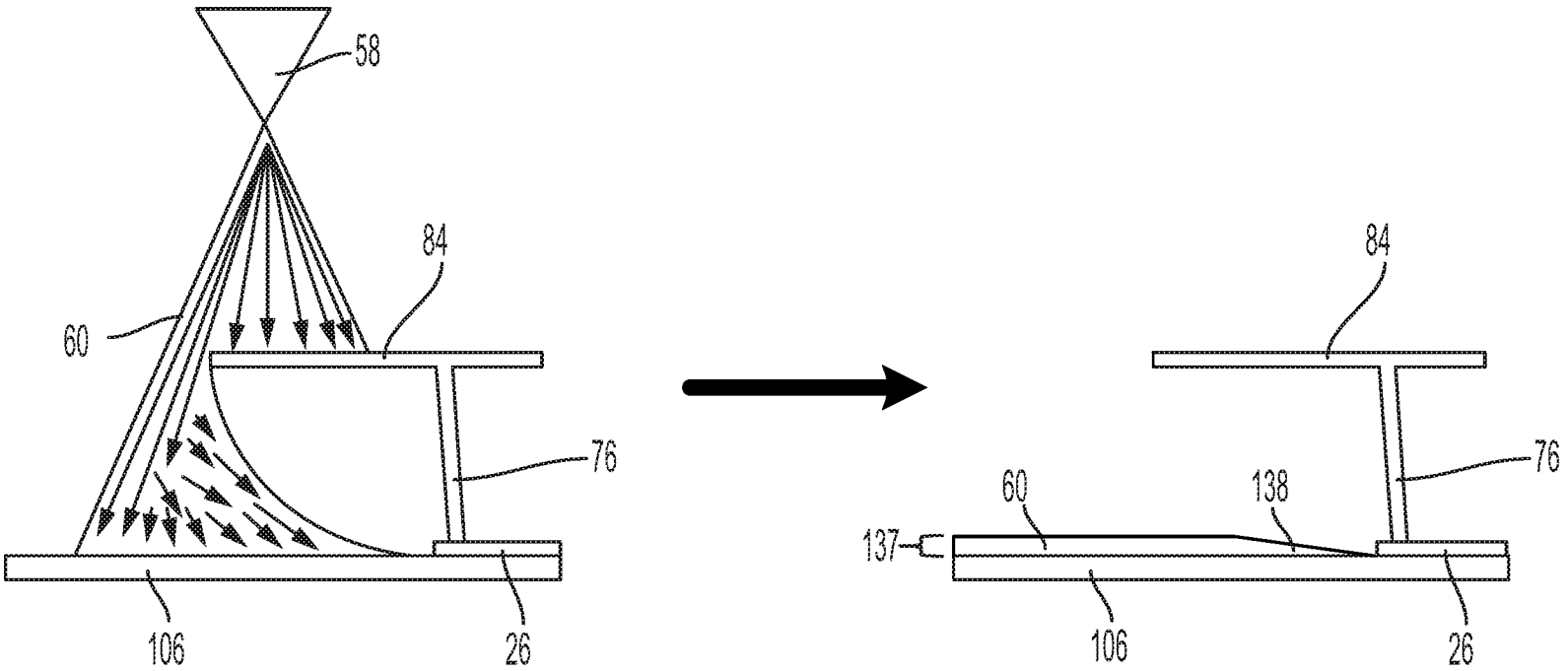
FIG. 5 shows side views of a representative pin of the flexible 3D maskant of FIG. 2 overhanging a surface, according to an example implementation.

FIG. 5 is a side view of a representative pin (namely, pin 76 from FIG. 2) overhanging the substantially flat surface 106. Further, FIG. 5 illustrates the atomizer nozzle 58 from the spray coating device 22 of FIG. 1. As shown, the material 60 can be sprayed by the atomizer nozzle 58 in a fan pattern. In alternative examples, the spray coating device 22 can spray the material 60 in other spray patterns. The material 60 can be paint or another type of material.

One or more layers of the material 60 can be spray coated onto the substantially flat surface 106 until the material 60 has a thickness 137 that is desired. As the material 60 is being sprayed, some of the material 60 is blocked by the head 84 of the pin 76 from being sprayed directly proximate to the flexible base structure 26. Instead, air currents can carry overspray of the material 60 from the left of fan pattern under the head 84, which results in a tapered or feathered effect 138. As will be described in more detail in later Figures, the height and/or angle of an individual member of the outermost subset 52 can affect the tapering profile of the material 60 proximate to the flexible base structure 26.

Figure 6:
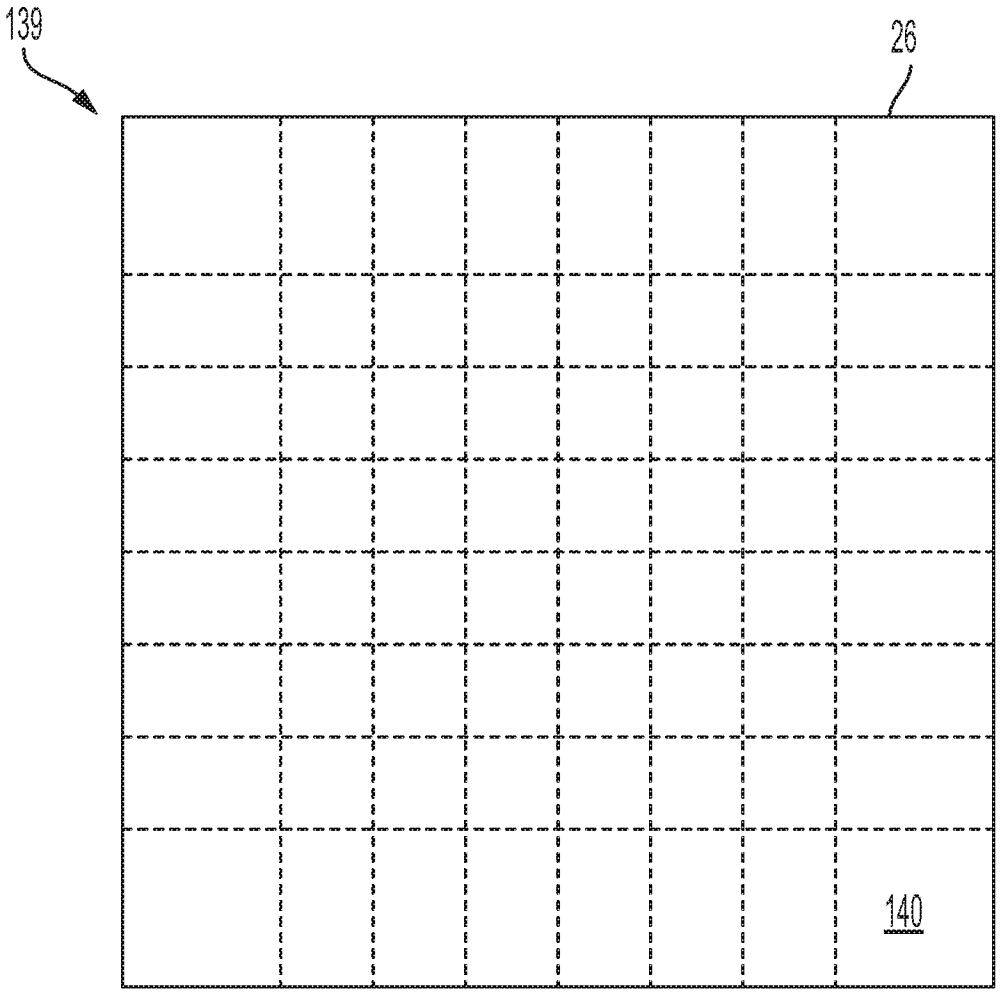
FIG. 6 shows a top-down view of a flexible base structure having a grid of flexure lines, according to an example implementation.

FIG. 6 is a top-down view of the flexible base structure 26. As shown, the flexible base structure 26 has a grid of flexure lines 139. The grid of flexure lines 139 represent locations at which the flexible base structure 26 is flexible and thus enable the flexible 3D maskant 20 to conform to various surface contours. Various types of members, such as the plurality of pins 72 described above, or other forms that the plurality of members 32 take, can be located at spaces defined by the grid of flexure lines 139, namely, the spaces whose borders are made of up of lines from the grid of flexure lines 139, such as space 140.

In embodiments where the flexible base structure 26 has the grid of flexure lines 139, the plurality of members 32 are separated by grooves corresponding to the grid of flexure lines 139, such that any two adjacent members of the plurality of members 32 that are separated by one of the grooves are independently movable. That is, each flexure line of the grid of flexure lines 139 represents a location at which a groove can be present. Thus, if two adjacent members are separated by a flexure line and the flexible base structure 26 bends at the flexure line, the two adjacent members can either move toward each other (e.g., if the bending is due to a concave surface) or away from each other (e.g., if the bending is due to a convex surface).

The distance at which adjacent members are separated from each other (i.e., a width of a groove between the adjacent members) can vary based on the surface to which the flexible 3D maskant 20 will be attached. For example, grooves between adjacent members may be wider for an embodiment of the flexible 3D maskant 20 that is to be attached to a concave surface, since the contour of a concave surface can cause adjacent members to move towards each other. In contrast, grooves between adjacent members can be made narrower for an embodiment of the flexible 3D maskant 20 that is to be attached to a convex surface, since the contour of the convex surface causes adjacent members to fan out away from each other.

The grid of flexure lines 139 is a representative example and, in other examples, the locations at which the flexible base structure 26 is flexible can vary.

Figure 7:
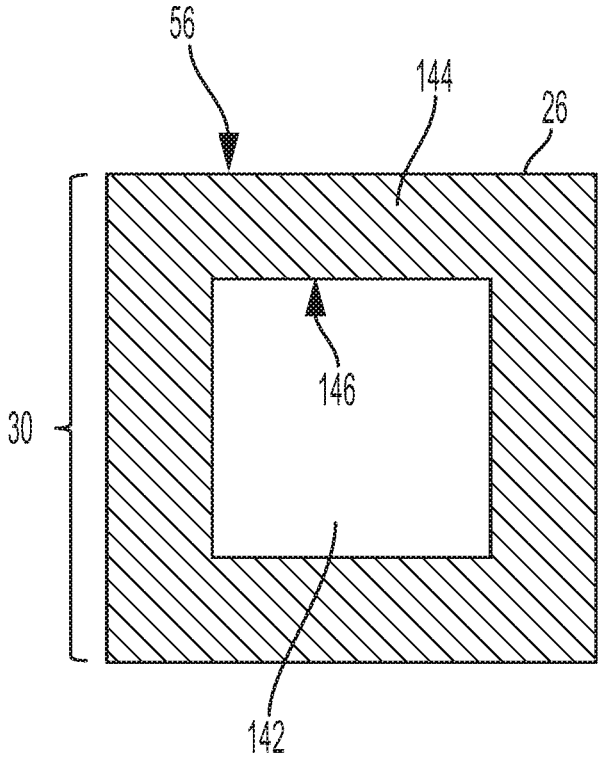
FIG. 7 shows another top-down view of a flexible base structure, according to an example implementation.

FIG. 7 shows another top-down view of the flexible base structure 26 and illustrates example regions of the second side 30 of the flexible base structure 26 at which members can be located. As shown, the second side 30 of the flexible base stricture 110 has a center region 142 and a perimeter region 144 around the center region 142. The perimeter region 144 is defined by the outer edge 56 of the flexible base structure 26 and an outer edge 146 of the center region 142.

The following example embodiments of the flexible 3D maskant 20 shown in FIGS. 8-12 each involve the plurality of members 32 and the flexible base structure 26 being integrally formed as a single piece. Further, in each of the example embodiments shown in FIGS. 8-12, the plurality of members 32 have configurations other than that of a pin.

Figure 8:
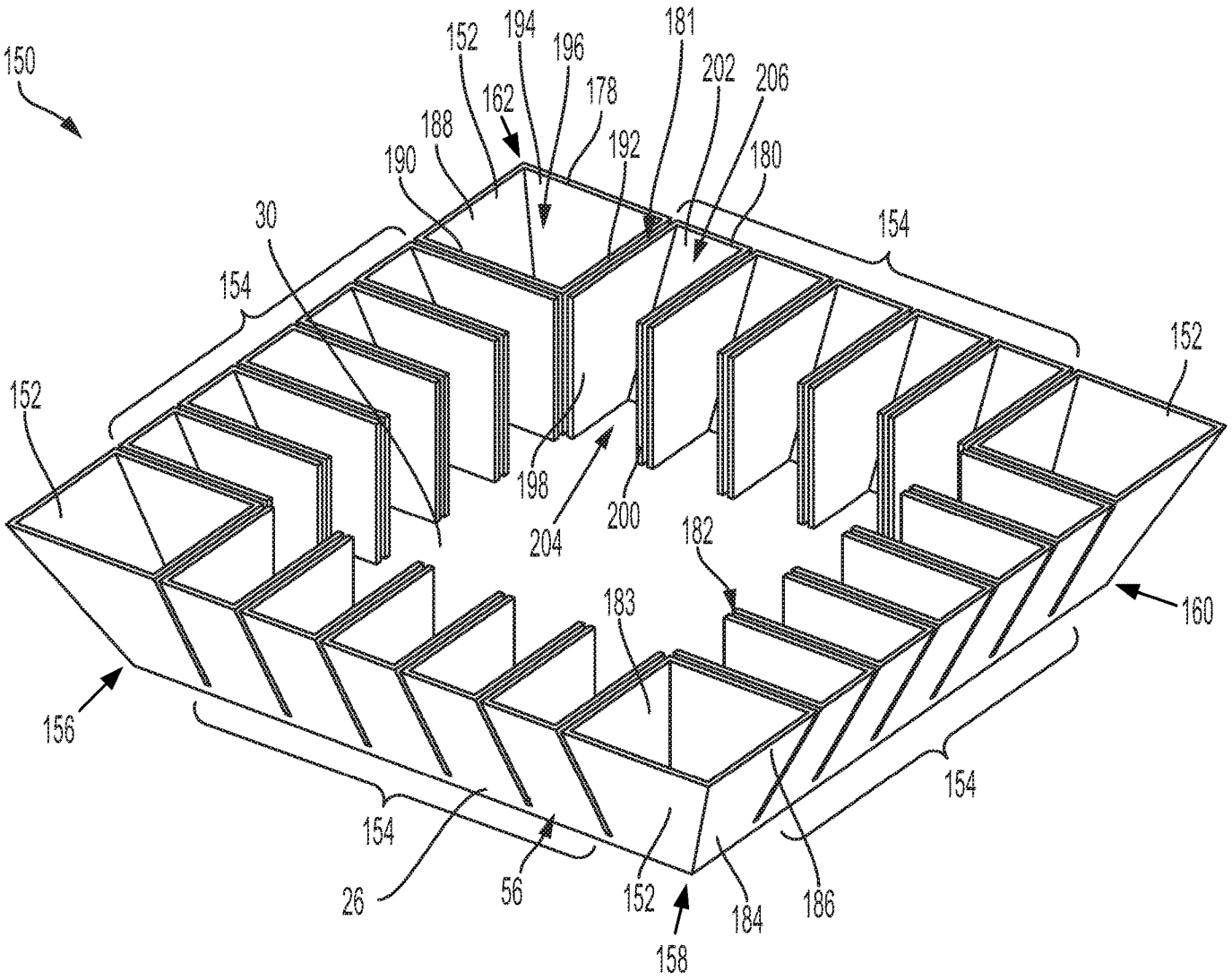
FIG. 8 shows a perspective view of another flexible 3D maskant, according to an example implementation.

FIG. 8 shows a perspective view of an example of a second flexible 3D maskant 150 in which the plurality of members 32 of FIG. 1 are attached to, and protrude from, the perimeter region 144 denoted in FIG. 7. As shown, the plurality of members 32 include (i) a first subset of members 152, each located at a respective corner of the flexible base structure 26, and (ii) a second subset of members 154 located between each pair of adjacent corners of the flexible base structure 26. Namely, the first subset of members 152 are located at corner 156, corner 158, corner 160, and corner 162, and the second subset of members 154 are located between corner 156 and corner 158, between corner 158 and corner 160, between corner 160 and corner 162, and between corner 156 and corner 162. Together, the first subset of members 152 and the second subset of members 154 embody the outermost subset 52 of FIG. 1.

Furthermore, every two adjacent members of the second flexible 3D maskant 150 are separated by a groove corresponding to a flexure line from a grid of flexure lines (e.g., the grid of flexure lines 139 denoted in FIG. 6). As a representative example, member 178 of the first subset of members 152 and member 180 of the second subset of members 154 are separated by groove 181 such that member 178 and member 180 are independently movable. Thus, when the second flexible 3D maskant 150 is attached to a surface (e.g., the substantially flat surface 106, the convex surface 110, or the concave surface 114), member 178 and member 180 can move towards each other, away from each other, or remain substantially stationary, depending on the contour of the surface. Other grooves are shown as well, such as groove 182.

Each member shown in FIG. 8 has a base end attached to the second side 30 of the flexible base structure 26 and (ii) a distal end. As a representative example, member 183 of the first subset of members 152 has a base end 184 and a distal end 186. Further, each member of the first subset of members 152, including member 178, has a first configuration, and each member of the second subset of members 154, including member 180, has a second configuration that is different from the first configuration. As shown, for example, member 178 has a partially-enclosed, five-sided polyhedron-shaped configuration formed by four connected quadrilateral faces, namely, face 188, face 190, face 192, and face 194, and the flexible base structure 26, with the flexible base structure 26 serving as the bottom of the member 178. Member 178 also has an open side 196, opposite the flexible base structure 26. With the first configuration, two of the four connected quadrilateral faces angle outward beyond the outer edge 56 of the flexible base structure 26, and thus overhang a surface (e.g., the substantially flat surface 106, the convex surface 110, or the concave surface 114) when the second flexible 3D maskant 150 is attached to the surface. For example, face 188 and face 194 angle outward beyond the outer edge 56 of the flexible base structure 26 and thus overhang a surface when the second flexible 3D maskant 150 is attached to the surface.

As further shown, member 180 has a partially-enclosed, four-sided polyhedron-shaped configuration formed by three connected quadrilateral faces—namely, face 198, face 200, and face 202—and the flexible base structure 26, with the flexible base structure 26 serving as the bottom of the member 180. The three connected quadrilateral faces include two faces—namely, face 198 and face 200—connected to opposite ends of a center face, namely, face 202. The center face angles outward beyond the outer edge 56 of the flexible base structure 26, and thus overhangs a surface when the second flexible 3D maskant 150 is attached to the surface. Further, member 180 is open on two sides. In particular, member 180 has a first open end 204 opposite the center face (i.e., face 202) and a second open end 206 opposite the flexible base structure 26.

The second flexible 3D maskant 150 is lightweight and the time and work required to manufacture the second flexible 3D maskant 150 is reduced. Further, the lack of members in the center region 142, as well as the presence of open sides/ends (e.g., open side 196, first open end 204, and second open end 206), make the second flexible 3D maskant 150 more efficient to clean after use. In addition, the open sides/ends enable the second flexible 3D maskant 150 to capture and collect sprayed paint in its members, thus preventing paint from escaping past the members and reaching undesired areas on the surface proximate to the second flexible 3D maskant 150. Further, the thin grooves present between adjacent members allow for flexibility when attached to a variety of differently-contoured surfaces, while still being thin enough to not allow much or any paint to escape past the members.

Moreover, while grooves between members can be made wider to account for movement of adjacent members when the second flexible 3D maskant 150 is attached to a concave surface, as discussed above, grooves can alternatively be kept narrow because the respective first open ends of the second subset of members 154 opposite the respective center faces provide compliance. For example, member 178 can move towards and against member 180, which may cause face 198 to move in compliance with the movement of member 178.

Figure 9:
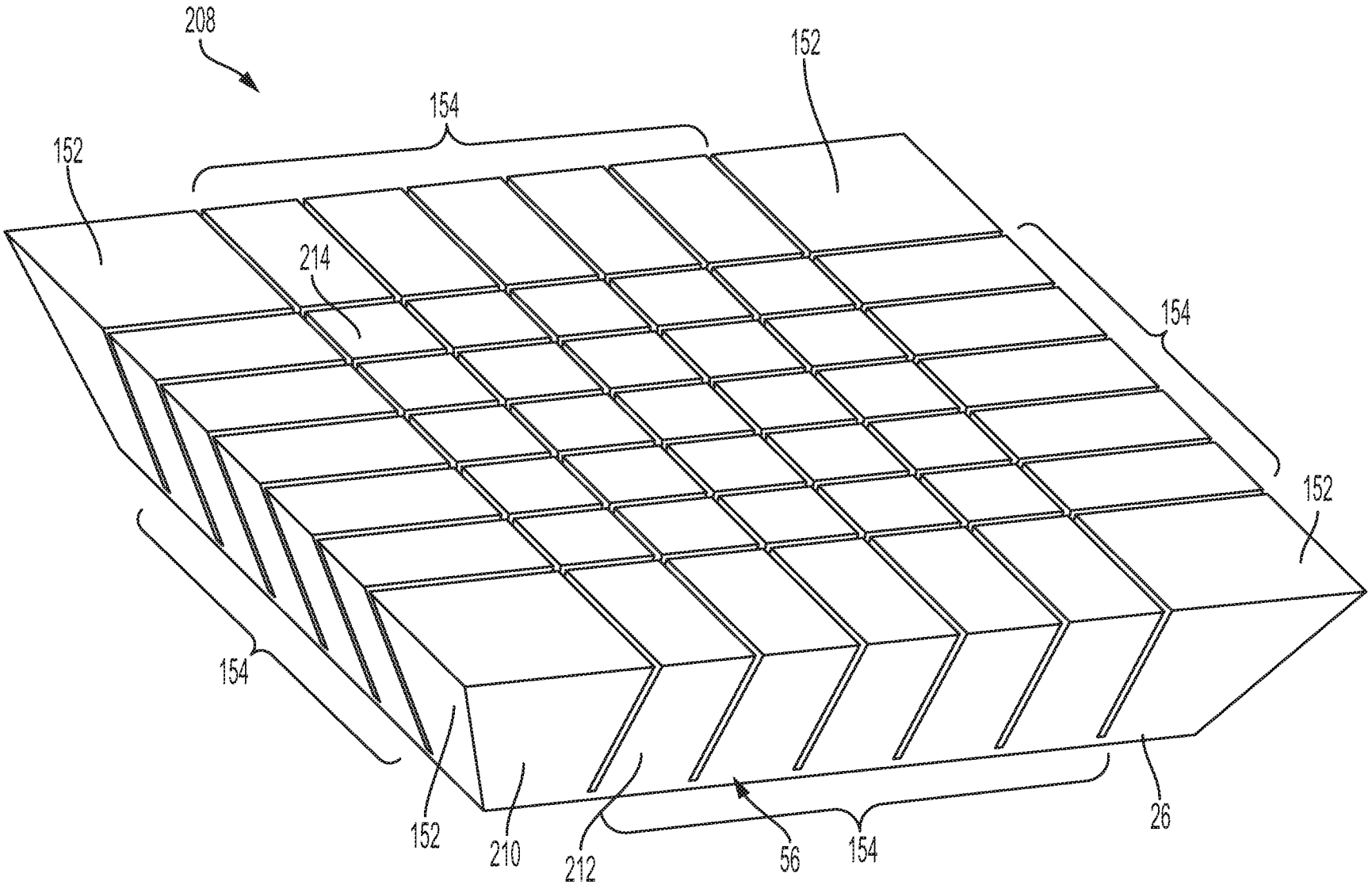
FIG. 9 shows a perspective view of another flexible 3D maskant, according to an example implementation.

FIG. 9 shows a perspective view of an example of a third flexible 3D maskant 208 in which the plurality of members 32 of FIG. 1 are attached to, and protrude from, both the perimeter region 144 and the center region 142 denoted in FIG. 7. More particularly, the third flexible 3D maskant 208 includes a respective member of the plurality of members 32 at each space formed by the grid of flexure lines 139 denoted in FIG. 6.

With the third flexible 3D maskant 208, the first subset of members 152 located at the corners of the third flexible 3D maskant 208, such as representative member 210, have a configuration similar to the first configuration described above, except that such members are fully-enclosed, six-sided polyhedron-shaped members with no open sides or ends. Further, the second subset of members 154 between adjacent corners, such as representative member 212, have a configuration similar to the second configuration described above, except that such members are fully-enclosed, six-sided polyhedron-shaped members. Additionally, other members of the third flexible 3D maskant 208, such as representative member 214, are located in the center region 142 (as denoted in FIG. 7) and are fully-enclosed, six-sided polyhedron-shaped members. Any given member can either be (i) solid or (ii) hollow and enclosed by six sides. Other member configurations are possible in alternative embodiments. Designed in this manner, the third flexible 3D maskant 208 can conform to a variety of differently-contoured surfaces and can enable efficient cleaning.

Figure 10:
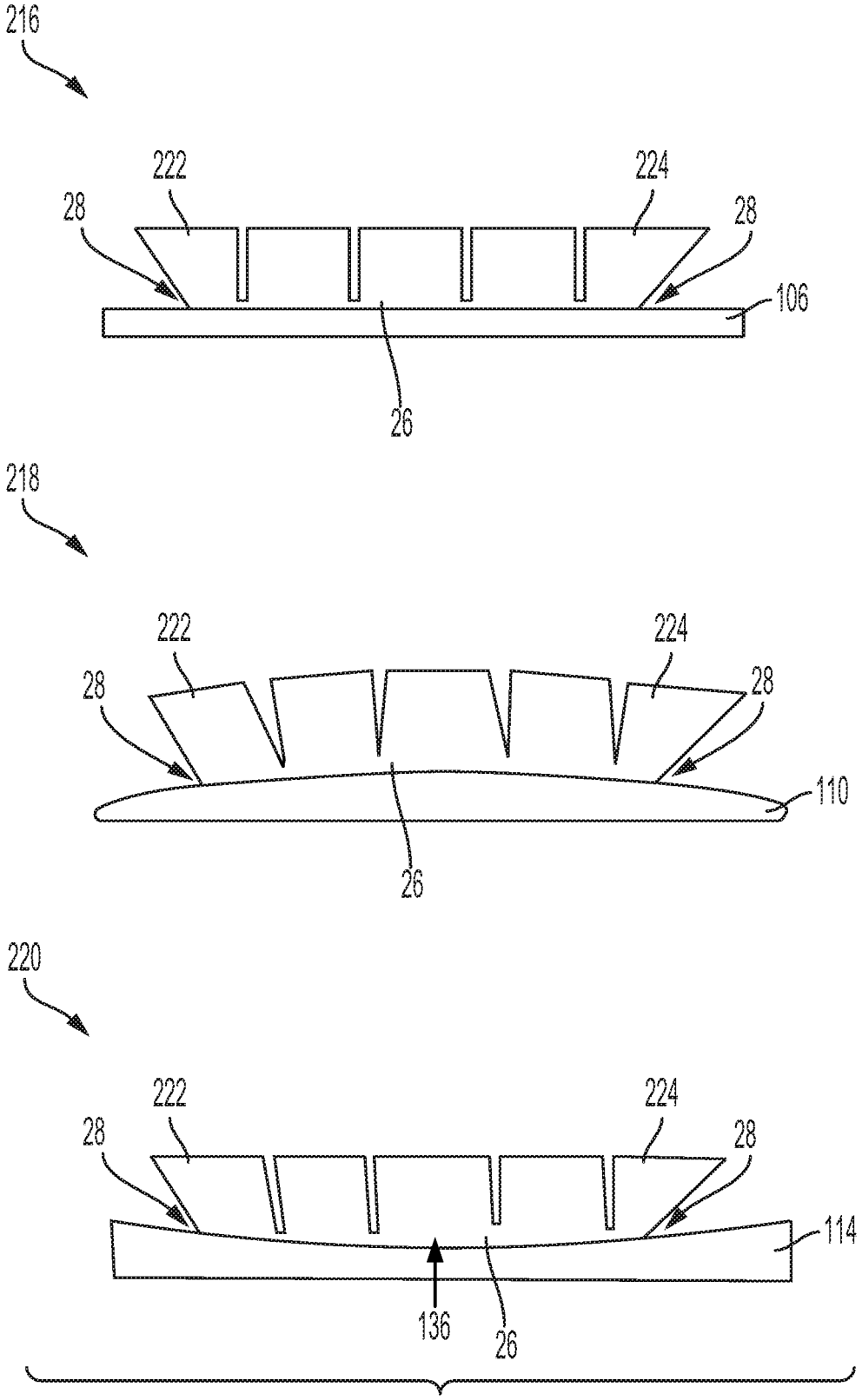
FIG. 10 shows three different cross-sectional views of the flexible 3D maskant of FIG. 8, according to an example implementation.

FIG. 10 shows cross-sectional views of an embodiment of the flexible 3D maskant 20 having a configuration similar to the second flexible 3D maskant 150 and the third flexible 3D maskant 208. In particular, FIG. 10 shows a respective cross-sectional view corresponding to each of three positions: a first position 216 where the flexible base structure 26 is attached to a substantially flat surface 106, a second position 218 where the flexible base structure 26 is attached to a convex surface 110, and a third position 220 where the flexible base structure 26 is attached to a concave surface 114. As shown by each of these positions, an embodiment of the flexible 3D maskant 20 that has a configuration similar to the second flexible 3D maskant 150 and the third flexible 3D maskant 208 can conform to a variety of differently-contoured surfaces, protect desired areas of the surfaces from paint overspray, and help create tapered or feathered edges, similar to the first flexible 3D maskant 70.

In the first position 216, the outermost subset 52 of the plurality of members 32 taper outward beyond the outer edge 56 of the flexible base structure 26. For example, member 222 and member 224 each taper outward and overhang as such.

In the second position 218, at least some of the plurality of members 32 fan out from each other, and the outermost subset 52 taper outward beyond the outer edge 56 of the flexible base structure 26. For example, member 222 and member 224 are fanned out and taper outward beyond the outer edge 56 of the flexible base structure 26.

In the third position 220, the outermost subset 52 of the plurality of members 32 move inward towards the center 136 of the flexible base structure 26 and taper outward beyond the outer edge 56 of the flexible base structure 26. For example, the concave nature of the concave surface 114 causes member 222 and member 224 to each move inward towards the center 136 of the flexible base structure 26, yet each still taper outward beyond the outer edge 56.

Figure 11:
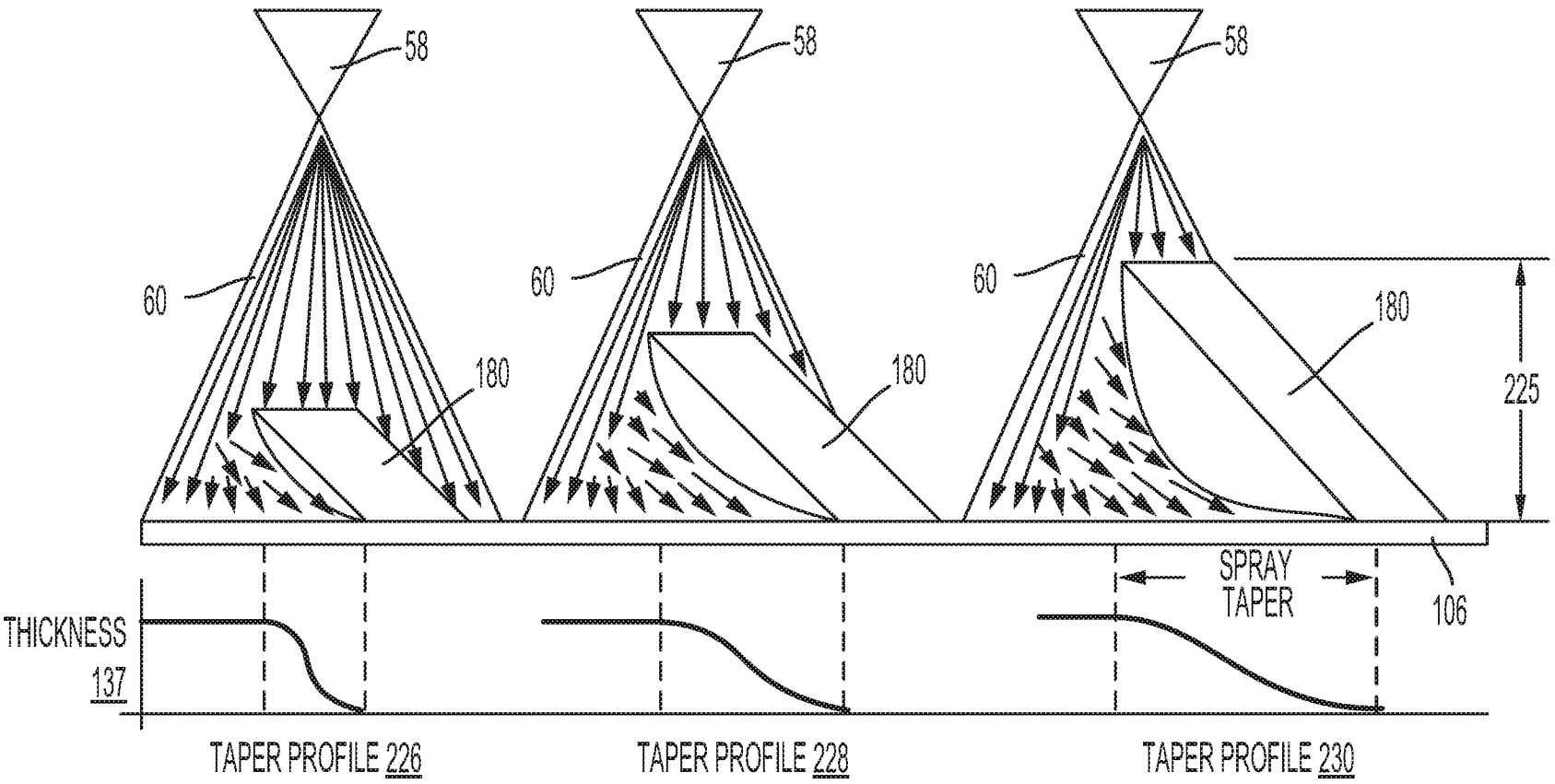
FIG. 11 shows side views a representative member of the flexible 3D maskant of FIG. 8 overhanging a surface, according to an example implementation.
Figure 12:
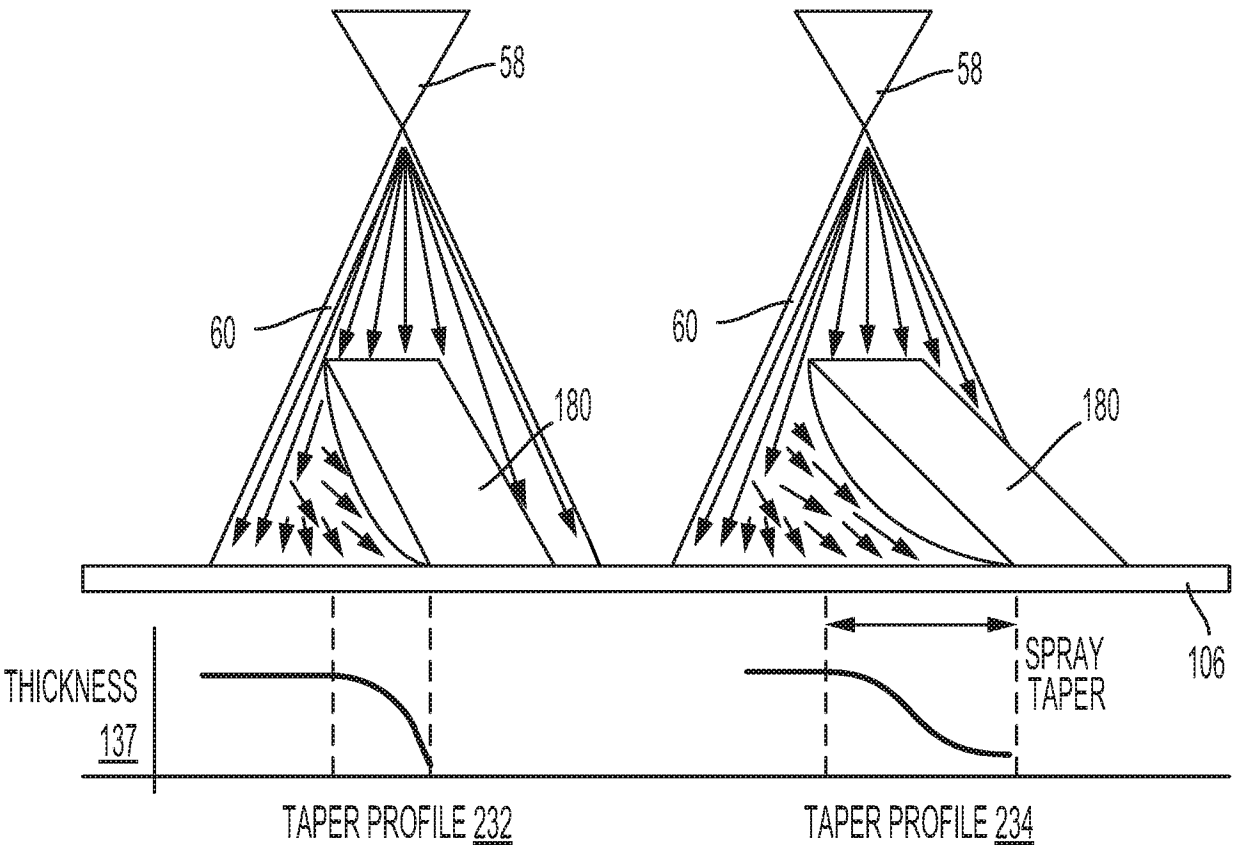
FIG. 12 shows other side views of the representative member of the flexible 3D maskant of FIG. 8 overhanging a surface, according to an example implementation.
Figure 13:
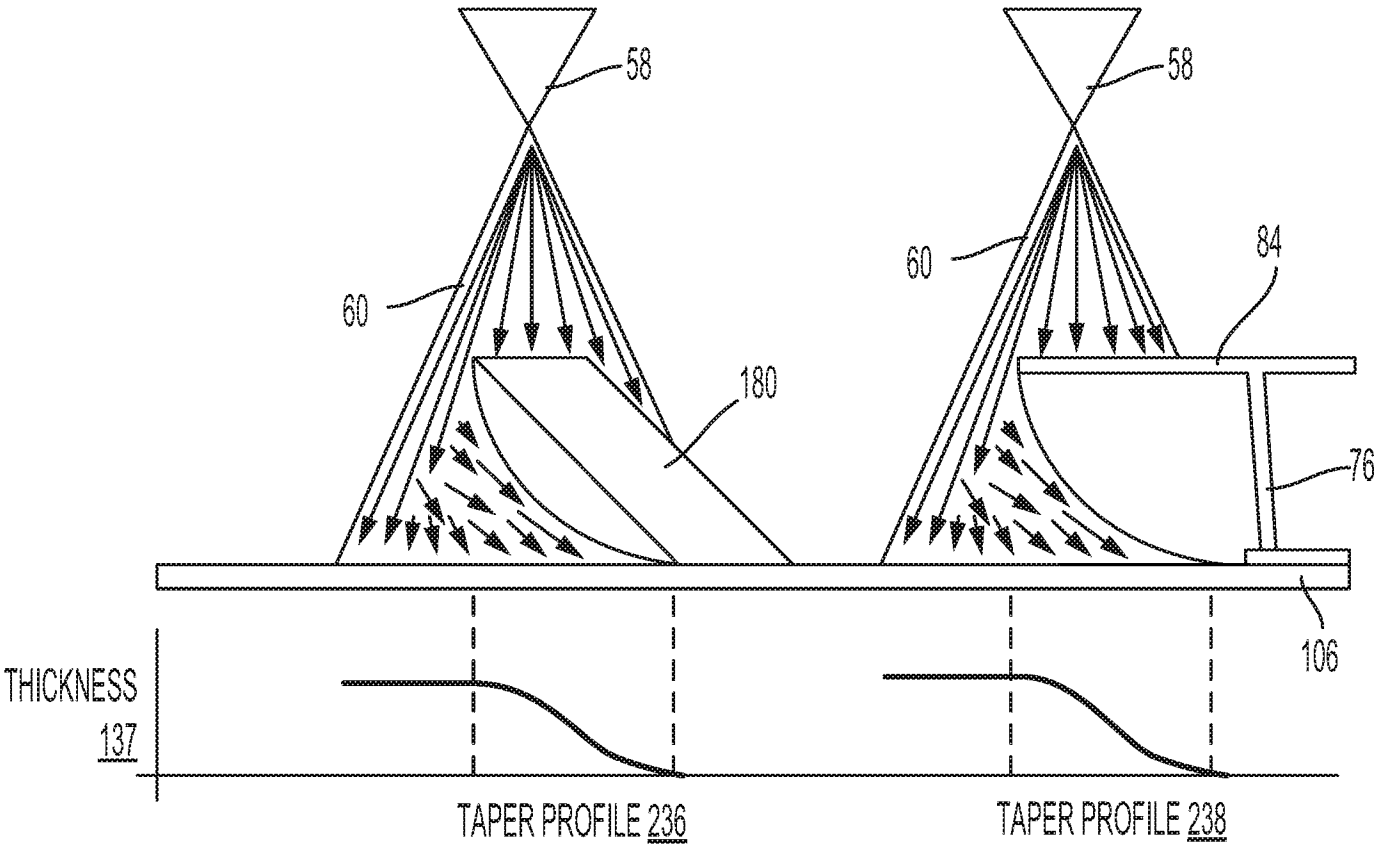
FIG. 13 shows a side view of the representative pin of the flexible 3D maskant of FIG. 2 overhanging a surface, as well as a side view of the representative member of the flexible 3D maskant of FIG. 8 overhanging a surface, according to an example implementation.

Thus, each of the three positions cause a tapered or feathered effect 138 proximate to the outer edge 56 of the flexible base structure 26. Example illustrations of this effect are shown in FIGS. 11-13. Each of FIGS. 11-13 illustrate the material 60 being sprayed by the atomizer nozzle 58 in a fan pattern.

FIG. 11 is a side view of member 180 of the second flexible 3D maskant 150 of FIG. 8 overhanging a substantially flat surface 106. In particular, FIG. 11 is a representative example of how a height 225 of a given member of the outermost subset 52 of the second flexible 3D maskant 150 (and, likewise, a height of a given member of the outermost subset 52 of the third flexible 3D maskant 208) can affect a taper profile for material 60 that is spray coated.

As the material 60 is being sprayed, some of the material 60 is blocked by the member 180, and air currents can carry overspray of the material 60 from the left of the fan pattern under the member 180. As shown, as the height 225 of the member 180 increases, the taper profile becomes less steep. For example, taper profile 226 is steeper than taper profile 228, and taper profile 228 is steeper than taper profile 230.

FIG. 12 is another side view of member 180 and is a representative example of how the angle of a given member of the outermost subset 52 of the second flexible 3D maskant 150 (and, likewise, the angle of a given member of the outermost subset 52 of the third flexible 3D maskant 208) can affect a taper profile for material 60 that is spray coated. As shown, as the angle between the substantially flat surface 106 and the member 180 decreases, the taper profile becomes less steep. For example, taper profile 232 is steeper than taper profile 234.

FIG. 13 is a side view of member 180, as well as a side view of pin 76 of the first flexible 3D maskant 70 of FIG. 2. In particular, FIG. 13 is a side-by-side comparison that shows how a taper profile 236 caused by member 180 is similar to a taper profile 238 caused by pin 76. For the pin 76 to cause a taper profile similar to that of member 180, for example, the degree to which the head 84 of the pin 76 extends horizontally over the substantially flat surface 106 and/or the height 225 of the pin 76 can be adjusted.

Generally, the height and/or angle of the outermost subset 52 of the plurality of members 32 of the flexible 3D maskant 20 can be based on the thickness 137 of at least one layer of the material 60 to be spray coated onto the surface 24. For example, in order to have a larger thickness, more layers will need to be sprayed. In this case, a less steep, more gradual taper profile is desired to account for the amount of material 60 that will be sprayed over the course of the multiple layers, and a small angle and/or large height can be selected to cause the more gradual taper profile to result. Other examples are possible as well.

Alternatively to the embodiments described above, some flexible 3D maskants might not include members, but still achieve the tapered or feathered effect 138 discussed herein.

Figure 14:
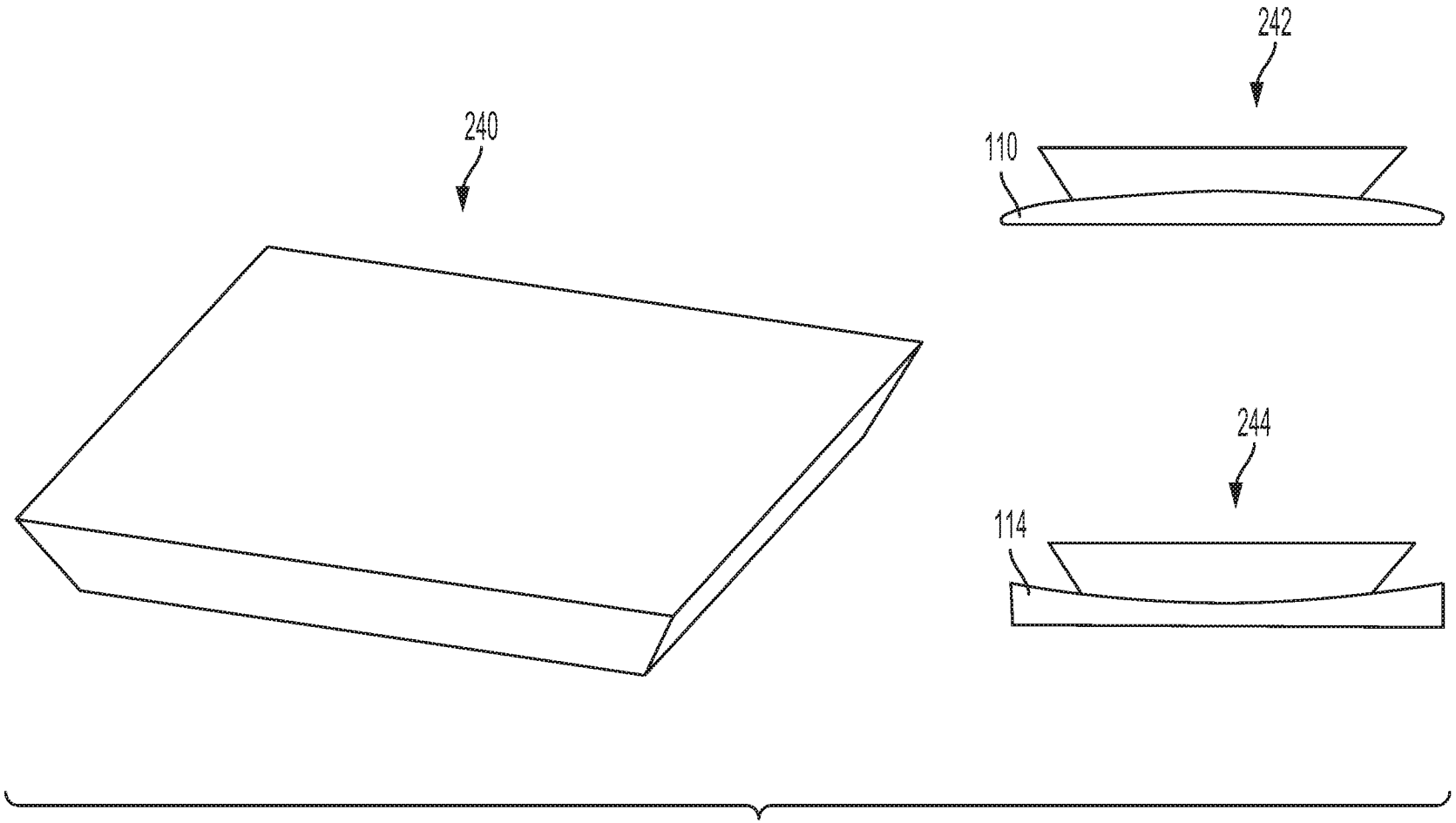
FIG. 14 shows a perspective view, as well as two different cross-sectional views, of another flexible 3D maskant, according to an example implementation.

FIG. 14 shows a perspective view of an example of a fourth flexible 3D maskant 240, as well as two different cross-sectional views showing how the fourth flexible 3D maskant 240 can be attached to differently-contoured surfaces. In particular, the fourth flexible 3D maskant 240 is a reusable design, enclosed on all six sides, with no grooves. The fourth flexible 3D maskant 240 can be a hollow shell or can be solid. The cross-sectional views illustrate a first position 242 where the fourth flexible 3D maskant 240 is attached to a convex surface 110, and a second position 244 where the fourth flexible 3D maskant 240 is attached to a concave surface 114. In either position, the outermost sides of the fourth flexible 3D maskant 240 angle outwards and overhang the respective surface. Although not shown in FIG. 14, the fourth flexible 3D maskant 240 can similarly be attached to a substantially flat surface 106.

Figure 15:
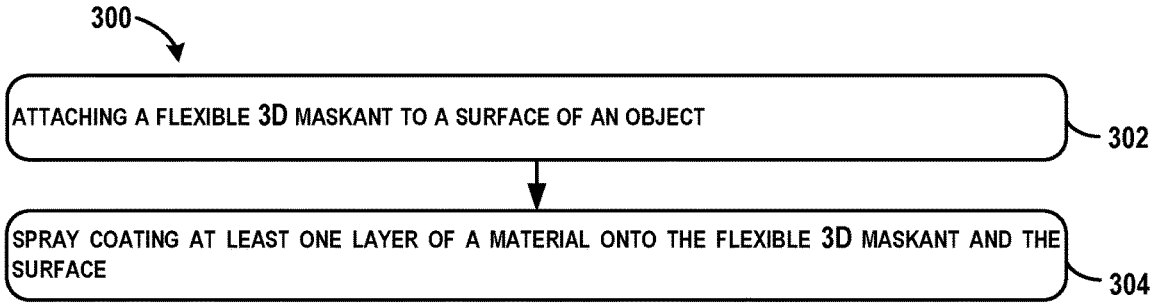
FIG. 15 shows a flowchart of an example method, according to an example implementation.

FIG. 15 shows a flowchart of an example of a method 300, according to an example implementation. Method 300 shown in FIG. 15 presents an example of a method that can be used with the flexible 3D maskants shown in FIG. 2, FIG. 8, and FIG. 9, and with the spray coating device shown in FIG. 1, for example. Further, devices or systems may be used or configured to perform logical functions presented in FIG. 15. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner. Method 300 may include one or more operations, functions, or actions as illustrated by one or more of blocks 302-304. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

It should be understood that for this and other processes and methods disclosed herein, flowcharts show functionality and operation of one possible implementation of present examples.

In addition, each block or portions of each block in FIG. 15, and within other processes and methods disclosed herein, may represent circuitry that is wired to perform the specific logical functions in the process. Alternative implementations are included within the scope of the examples of the present disclosure in which functions may be executed out of order from that shown or discussed, including substantially concurrent or in reverse order, depending on the functionality involved, as would be understood by those reasonably skilled in the art.

At block 302, the method 300 includes attaching a flexible 3D maskant to a surface. The flexible 3D maskant comprises a flexible base structure and a plurality of members. The flexible base structure is configured to attach and conform to the surface. The flexible base structure has a first side and a second side opposite the first side. The first side is configured to attach to the surface. Attaching the flexible 3D maskant to the surface comprises attaching the first side of the flexible base structure to the surface. The plurality of members are attached to, and protruding from, the second side of the flexible base structure. Each member of the plurality of members comprises (i) a base end attached to the second side of the flexible base structure and (ii) a distal end. An outermost subset of the plurality of members are positioned along an outer edge of the flexible base structure. Each distal end of the outermost subset of the plurality of members extends outward beyond the outer edge of the flexible base structure and overhang the surface.

At block 304, the method 300 includes spray coating at least one layer of a material onto the flexible 3D maskant and the surface.

Figure 16:
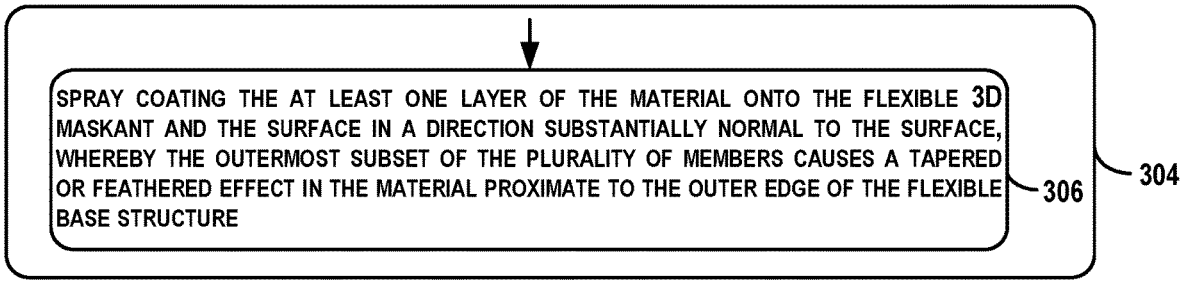
FIG. 16 shows a flowchart of an example method for performing the spray coating function of the method of FIG. 15, according to an example implementation.

FIG. 16 shows a flowchart of an example method for performing the spray coating as shown in block 304, according to an example implementation. At block 306, functions include spray coating the at least one layer of the material onto the flexible 3D maskant and the surface in a direction substantially normal to the surface, whereby the outermost subset of the plurality of members causes a tapered or feathered effect in the material proximate to the outer edge of the flexible base structure.

As discussed above, the flexible 3D maskant can take various forms and the plurality of members can take various positions when attached to different types of surfaces. For example, the plurality of members can be embodied as a plurality of pins. As such, in a first position where the flexible base structure is attached to a substantially flat surface, heads of the outermost subset extend outward beyond the outer edge of the flexible base structure. Further, in a second position where the flexible base structure is attached to a convex surface, the heads of the outermost subset and shafts of the outermost subset angle outward beyond the outer edge of the flexible base structure. And, in a third position where the flexible base structure is attached to a concave surface, the shafts of the outermost subset angle inward towards a center of the flexible base structure and the heads of the outermost subset extend outward beyond the outer edge of the flexible base structure.

Different examples of the system(s), device(s), and method(s) disclosed herein include a variety of components, features, and functionalities. It should be understood that the various examples of the system(s), device(s), and method(s) disclosed herein may include any of the components, features, and functionalities of any of the other examples of the system(s), device(s), and method(s) disclosed herein in any combination or any sub-combination, and all of such possibilities are intended to be within the scope of the disclosure.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

What is claimed is:

1. A flexible three-dimensional (3D) maskant comprising:

a flexible base structure comprising a first side and a second side opposite the first side, wherein the first side is configured to attach and conform to a surface of an object being spray coated; and a plurality of members attached to, and protruding from, the second side of the flexible base structure, wherein each member of the plurality of members comprises (i) a base end attached to the second side of the flexible base structure and (ii) a distal end, wherein an outermost subset of the plurality of members are positioned along an outer edge of the flexible base structure, and wherein each distal end of the outermost subset extends outward beyond the outer edge of the flexible base structure, thereby overhanging the surface of the object being spray coated when the flexible 3D maskant is attached to the surface of the object being spray coated.

2. The flexible 3D maskant of claim 1, wherein the outermost subset are configured such that, when the flexible 3D maskant is attached to the surface of the object being spray coated and at least one layer of a material is spray coated onto the flexible 3D maskant and the surface of the object being spray coated, the outermost subset causes a tapered or feathered effect in the material proximate to the outer edge of the flexible base structure.

3. The flexible 3D maskant of claim 1, wherein the plurality of members comprises a plurality of pins inserted into the flexible base structure, and wherein each of the plurality of pins comprises a shaft connected to a head.

4. The flexible 3D maskant of claim 3, wherein the flexible base structure has a first surface area, and wherein heads of the plurality of pins define a second surface area that is greater than the first surface area.

5. The flexible 3D maskant of claim 3, wherein, in a first position where the flexible base structure is attached to a substantially flat surface, heads of the outermost subset extend outward beyond the outer edge of the flexible base structure, wherein, in a second position where the flexible base structure is attached to a convex surface, the heads of the outermost subset and shafts of the outermost subset angle outward beyond the outer edge of the flexible base structure, and wherein, in a third position where the flexible base structure is attached to a concave surface, the shafts of the outermost subset angle inward towards a center of the flexible base structure and the heads of the outermost subset extend outward beyond the outer edge of the flexible base structure.

6. The flexible 3D maskant of claim 3, wherein shafts of the outermost subset are longer than shafts of an inner subset of the plurality of pins, and wherein heads of the outermost subset at least partially overlap heads of the inner subset.

7. The flexible 3D maskant of claim 3, wherein the plurality of pins comprises one or more of polytetrafluoroethylene or plastic.

8. The flexible 3D maskant of claim 1, wherein the plurality of members and the flexible base structure are integrally formed as a single piece.

9. The flexible 3D maskant of claim 1, wherein the flexible base structure comprises a grid of flexure lines at which the flexible base structure is flexible, and wherein the plurality of members are separated by grooves corresponding to the grid of flexure lines such that any two adjacent members of the plurality of members that are separated by one of the grooves are independently movable.

10. The flexible 3D maskant of claim 9, wherein the second side of the flexible base structure has a center region and perimeter region around the center region, wherein the perimeter region is defined by the outer edge of the flexible base structure and an outer edge of the center region, and wherein the plurality of members are attached to, and protrude from, the perimeter region.

11. The flexible 3D maskant of claim 10, wherein the plurality of members includes:

a first subset of members, each located at a respective corner of the flexible base structure and each having a first configuration, and a second subset of members located between each pair of adjacent corners of the flexible base structure and each having a second configuration different from the first configuration.

12. The flexible 3D maskant of claim 11, wherein the first configuration comprises a partially-enclosed, five-sided polyhedron-shaped configuration, and wherein the second configuration comprises a partially-enclosed, four-sided polyhedron-shaped configuration.

13. The flexible 3D maskant of claim 9, wherein the plurality of members includes a respective member at each space formed by the grid of flexure lines.

14. The flexible 3D maskant of claim 13, wherein the plurality of members is a plurality of fully-enclosed, six-sided polyhedron-shaped members.

15. The flexible 3D maskant of claim 1, wherein a height of the outermost subset is based on a thickness of at least one layer of a material to be spray coated onto the surface of the object being spray coated.

16. The flexible 3D maskant of claim 1, wherein the flexible base structure of the flexible 3D maskant comprises polyurethane.

17. A method comprising:

attaching a flexible three-dimensional (3D) maskant to a surface of an object, wherein the flexible 3D maskant comprises:

a flexible base structure comprising a first side and a second side opposite the first side, wherein the first side is configured to attach and conform to the surface of the object, and wherein attaching the flexible 3D maskant to the surface comprises attaching the first side of the flexible base structure to the surface of the object, and a plurality of members attached to, and protruding from, the second side of the flexible base structure, wherein each member of the plurality of members comprises (i) a base end attached to the second side of the flexible base structure and (ii) a distal end, wherein an outermost subset of the plurality of members are positioned along an outer edge of the flexible base structure, and wherein each distal end of the outermost subset extends outward beyond the outer edge of the flexible base structure and overhang the surface of the object; and spray coating at least one layer of a material onto the flexible 3D maskant and the surface of the object.

18. The method of claim 17, wherein spray coating the at least one layer of the material onto the flexible 3D maskant and the surface of the object comprises spray coating the at least one layer of the material onto the flexible 3D maskant and the surface of the object in a direction substantially normal to the surface, whereby the outermost subset causes a tapered or feathered effect in the material proximate to the outer edge of the flexible base structure.

19. A spray coating system comprising:

a spray coating device having an atomizer nozzle, wherein the spray coating device is configured for spray coating at least one layer of a material onto a flexible three-dimensional (3D) maskant and a surface of an object; and the flexible 3D maskant, comprising:

a flexible base structure comprising a first side and a second side opposite the first side, wherein the first side is configured to attach and conform to the surface of the object, and a plurality of members attached to, and protruding from, the second side of the flexible base structure, wherein each member of the plurality of members comprises (i) a base end attached to the second side of the flexible base structure and (ii) a distal end, wherein an outermost subset of the plurality of members are positioned along an outer edge of the flexible base structure, and wherein each distal end of the outermost subset extends outward beyond the outer edge of the flexible base structure, thereby overhanging the surface of the object when the flexible 3D maskant is attached to the surface of the object.

20. The spray coating system of claim 19, wherein the outermost subset are configured such that, when the flexible 3D maskant is attached to the surface of the object and the at least one layer of the material is spray coated onto the flexible 3D maskant and the surface of the object, the outermost subset causes a tapered or feathered effect in the material proximate to the outer edge of the flexible base structure.

* * * * *